US011331707B2

(12) United States Patent
Niinomi

(10) Patent No.: US 11,331,707 B2
(45) Date of Patent: May 17, 2022

(54) METHOD OF MANUFACTURING PIPE

(71) Applicant: FUTABA INDUSTRIAL CO., LTD., Aichi (JP)

(72) Inventor: Hirotaka Niinomi, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 114 days.

(21) Appl. No.: 16/774,506

(22) Filed: Jan. 28, 2020

(65) Prior Publication Data

US 2020/0246853 A1 Aug. 6, 2020

(30) Foreign Application Priority Data

Feb. 4, 2019 (JP) ..... JP2019-018046

(51) Int. Cl.
*B21D 5/00* (2006.01)
*B21D 5/10* (2006.01)
(Continued)

(52) U.S. Cl.
CPC ..... *B21D 5/10* (2013.01); *B21D 5/015* (2013.01); *B21D 37/10* (2013.01); *B21D 51/10* (2013.01); *B21D 51/16* (2013.01)

(58) Field of Classification Search
CPC ..... B21C 37/107; B21C 37/155; B21C 37/08; B21C 37/0803; B21C 37/0815;
(Continued)

(56) References Cited

U.S. PATENT DOCUMENTS 1,462,467 A * 7/1923 White ..... B21D 51/10 74/588
3,693,398 A * 9/1972 Pedersen ..... B21D 51/10 72/368
(Continued)

FOREIGN PATENT DOCUMENTS

CA 2967914 A1 * 6/2016 ..... B21D 5/01
JP 59199117 A * 11/1984 ..... B21D 5/015
(Continued)

OTHER PUBLICATIONS

Belato et al. "Latest Developments in Mechanical Properties and Metallurgical Features of High Strength Line Pipe Steels", Feb. 2013, p. 3 (Year: 2013).*
(Continued)

*Primary Examiner* — Debra M Sullivan
(74) *Attorney, Agent, or Firm* — David D. Brush; Westman, Champlin & Koehler, P.A.

(57) ABSTRACT

A pipe is formed by press molding a U-shaped member including a U-shaped cross section. The U-shaped cross section includes at least five curved portions. The curved portions include a center curved portion facing an opening of the U-shaped cross section defined by both edges of the U-shaped cross section; a first right curved portion; a second right curved portion; a first left curved portion; and a second left curved portion. At least the center curved portion, the first right curved portion, and the first left curved portion each have a radius of curvature smaller than a radius of curvature of a corresponding portion of the pipe cross section.

20 Claims, 5 Drawing Sheets

(51) Int. Cl.

| | |
|---|---|
| ***B21D 51/16*** | (2006.01) |
| ***B21D 51/10*** | (2006.01) |
| ***B21D 5/01*** | (2006.01) |
| ***B21D 37/10*** | (2006.01) |

(58) Field of Classification Search

CPC ..... B21C 37/02; B21C 37/06; B21C 37/0826; B21D 5/01; B21D 5/015; B21D 11/203; B21D 39/02; B21D 53/16; B21D 53/18; B21D 51/10; B21D 5/06; B21D 5/08; B21D 5/086; B21D 5/10

USPC ..... 72/367.1, 368, 370.26

See application file for complete search history.

(56) References Cited

U.S. PATENT DOCUMENTS 4,309,890 A * 1/1982 Ichikawa ..... B21D 51/10 29/898.057

2015/0097350 A1* 4/2015 Shirakami ..... B60G 7/001 280/124.134

2015/0114070 A1* 4/2015 Higai ..... B21D 39/02 72/356

FOREIGN PATENT DOCUMENTS

JP 59209425 A * 11/1984 ..... B21D 5/015

JP H09234511 A 9/1997

JP 2001252722 A 9/2001

JP 2004141936 A * 5/2004

JP 2016059938 A 4/2016

OTHER PUBLICATIONS

English translation of Notice of Reasons for Refusal dated Feb. 9, 2021 for corresponding Japanese Application No. 2019-018046, filed Feb. 4, 2019.

* cited by examiner

METHOD OF MANUFACTURING PIPE

CROSS-REFERENCE TO RELATED APPLICATIONS

This application claims the benefit of Japanese Patent Application No. 2019-018046 filed on Feb. 4, 2019 with the Japan Patent Office, the entire disclosure of which is incorporated herein by reference.

BACKGROUND

The present disclosure relates to a method of manufacturing a pipe by press molding.

A method of manufacturing a pipe by bending a metallic plate member first into a U-shape (U-shape bending) and then into an O-shape (O-shape bending) is known (for example, Japanese Unexamined Patent Application Publication No. 2016-059938). The plate member is formed into a pipe and both edges of the plate member face each other by O-shape bending. The facing edges (hereinafter collectively referred to as facing area) of the O-shaped plate member are welded together.

SUMMARY

Springback sometimes occurs after the O-shape bending, which separates the facing edges and creates a gap in the facing area. Particularly, large springback can occur when the plate member is high-tensile strength steel. Due to such springback, a gap is likely to occur in the facing area, which may make welding difficult and may cause inconsistency in welding quality.

In one aspect of the present disclosure, it is desirable that an occurrence of a gap is inhibited in a facing area of a pipe.

One aspect of the present disclosure is a method of manufacturing a pipe. The method first includes press molding a metallic plate member to form a U-shaped member that extends in an elongation direction and includes a U-shaped cross section taken orthogonally to the elongation direction. The method then includes press molding the U-shaped member to form the pipe that extends in the elongation direction. The U-shaped cross section includes at least five curved portions expanding outwards. The curved portions include a center curved portion facing an opening of the U-shaped cross section defined by both edges of the U-shaped cross section. A U-shaped member center line, which is a straight line, passes through the opening and the center curved portion of the U-shaped cross section. One side of the U-shaped cross section with respect to the U-shaped member center line is a right side; and an other side of the U-shaped cross section with respect to the U-shaped member center line is a left side. The curved portions also include a first right curved portion and a second right curved portion on the right side, and a first left curved portion and a second left curved portion on the left side. The second right curved portion is located on an opening side of the first right curved portion. The second left curved portion is located on an opening side of the first left curved portion. The pipe includes a pipe cross section that is a cross section taken orthogonally to the elongation direction. Among the curved portions, at least the center curved portion, the first right curved portion, and the first left curved portion each have a radius of curvature smaller than a radius of curvature of a corresponding portion of the pipe cross section.

The pipe, formed by curving the plate member, includes the facing area that is formed by both edges of the curved plate member facing each other. According to the aforementioned configuration, the radius of curvature of each of the center curved portion, the first right curved portion, and the first left curved portion of the U-shaped cross section is smaller than the radius of curvature of the corresponding portion of the pipe cross section. Thus, these portions are deformed so as to increase the radius of curvature when press molding the pipe from the U-shaped member. As a result, springback occurs in the corresponding portions of the pipe so as to decrease the radius of curvature. In the facing area, this springback acts on the both edges of the plate member as a force (hereinafter referred to as closing force) to make the both edges approach each other.

In the U-shaped cross section of the aforementioned configuration, the second right curved portion and the second left curved portion are located respectively on an opening side of the first right curved portion and on an opening side of the first left curved portion. The both edges of the U-shaped cross section can further approach each other. This allows a favorable approach of the both edges of the plate member in the facing area when forming a pipe from the U-shaped member.

Accordingly, an occurrence of a gap is inhibited in the facing area of the pipe.

In one aspect of the present disclosure, the pipe cross section may include an approximately circular shape.

According to the aforementioned configuration, an occurrence of a gap can be inhibited in the facing area when manufacturing the pipe having an approximately circular pipe cross section.

In one aspect of the present disclosure, the length of the opening of the U-shaped cross section may be less than a length of a diameter of the pipe cross section.

According to the aforementioned configuration, the distance between the both edges of the U-shaped cross section facing each other across the opening is reduced. This allows the both edges of the plate member in the facing area of the pipe favorably approach each other when forming the pipe from the U-shaped member, and as a consequence, inhibits an occurrence of a gap in the facing area.

In one aspect of the present disclosure, each of the second right curved portion and the second left curved portion of the U-shaped cross section may extend from one end of the U-shaped cross section or from proximity to the one end of the U-shaped cross section. The radiuses of curvature of the second right curved portion and the second left curved portion may each be approximately identical to a radius of curvature of a corresponding portion of the pipe cross section.

According to the aforementioned configuration, the right edge and the left edge of the U-shaped member can favorably approach each other when press molding the pipe from the U-shaped member. At the same time, changes in the radiuses of curvature of the second right curved portion and the second left curved portion can be inhibited. This consequently reduces an occurrence of springback in the portions of the pipe corresponding to the second right curved portion and the second left curved portion. Accordingly, an occurrence of a gap in the facing area of the pipe can be further inhibited.

In one aspect of the present disclosure, the radiuses of curvature of the second right curved portion and the second left curved portion may each be smaller than a radius of curvature of a corresponding portion of the pipe cross section.

According to the aforementioned configuration, springback occurs to reduce the radiuses of curvature also at the portions of the pipe corresponding to the second right curved portion and the second left curved portion in addition to the portions of the pipe corresponding to the center curved portion, the first right curved portion, and the first left curved portion. This helps increase the closing force acting in the facing area of the pipe, and thus further inhibits an occurrence of a gap in the facing area.

In one aspect of the present disclosure, a pipe center line, which is a straight line, passes through a facing area where both edges of the pipe cross section face each other and a most distant point of the pipe cross section from the facing area. The pipe cross section may also include a right-most distal point that is the most distant point from the pipe center line in a portion corresponding to the right side of the U-shaped cross section. The pipe cross section may also include a left-most distal point that is the most distant point from the pipe center line in a portion corresponding to the left side of the U-shaped cross section. A portion of the pipe cross section corresponding to the first right curved portion may include the right-most distal point or may be located in proximity to the right-most distal point. A portion of the pipe cross section corresponding to the first left curved portion may include the left-most distal point or may be located in proximity to the left-most distal point.

According to the aforementioned configuration, springback occurring at the portions of the pipe corresponding to the first right curved portion and the first left curved portion of the U-shaped cross section enable the closing force to effectively act in the facing area. Thus, an occurrence of a gap in the facing area of the pipe can be further inhibited.

In one aspect of the present disclosure, the U-shaped cross section may be of an approximately line-symmetric shape having the U-shaped member center line being a symmetrical axis.

According to the aforementioned configuration, the portion of the pipe cross section corresponding to the center curved portion of the U-shaped cross section is located in an approximately line-symmetric manner with respect to the symmetrical axis passing the facing area. Similarly, the portions of the pipe cross section corresponding to the first right curved portion and the first left curved portion of the U-shaped cross section are located in an approximately line-symmetric manner with each other with respect to the symmetrical axis. The portions of the pipe cross section corresponding to the second right curved portion and the second left curved portion of the U-shaped cross section are likewise located in an approximately line-symmetric manner with each other with respect to the symmetrical axis. This can help encourage springback, which reduces the radiuses of curvature, to occur at approximately identical extent and at approximately line-symmetrical locations with respect to the symmetrical axis of the pipe cross section. As a result, it is possible to encourage uniform closing forces to act on both of the edges of the plate member in the facing area of the pipe. Accordingly, the pipe can be favorably formed from the U-shaped member.

In one aspect of the present disclosure, a tensile strength of the plate member may be equal to or greater than 780 MPa.

According to the aforementioned configuration, an occurrence of a gap in the facing area of the pipe can be inhibited when manufacturing the pipe from a plate member having a tensile strength equal to or greater than 780 MPa.

In one aspect of the present disclosure, the pipe may be a component included in a framework of an automobile. According to the aforementioned configuration, a component included in a framework of an automobile can be favorably manufactured.

In one aspect of the present disclosure, the press molding of the U-shaped member may be performed by using at least a first metallic mold for pressing a part of the U-shaped member including the both edges of the U-shaped cross section and a second metallic mold for pressing an other part of the U-shaped member including the center curved portion.

According to the aforementioned configuration, the press molding of the U-shaped member can be favorably performed.

In one aspect of the present disclosure, the press molding of the U-shaped member may include at least interposing and pressing the U-shaped member between the first metallic mold and the second metallic mold, both moving along the U-shaped member center line. According to the aforementioned configuration, the press molding of the U-shaped member can be favorably performed.

BRIEF DESCRIPTION OF THE DRAWINGS

An example embodiment of the present disclosure will be described hereinafter with reference to the accompanying drawings, in which.

DETAILED DESCRIPTION OF THE PREFERRED EMBODIMENTS

The present disclosure is not limited to the embodiments explained hereinafter and may be modified in various modes within the technical scope of the present disclosure.

Embodiment 1

1. Outline

Figure 1:
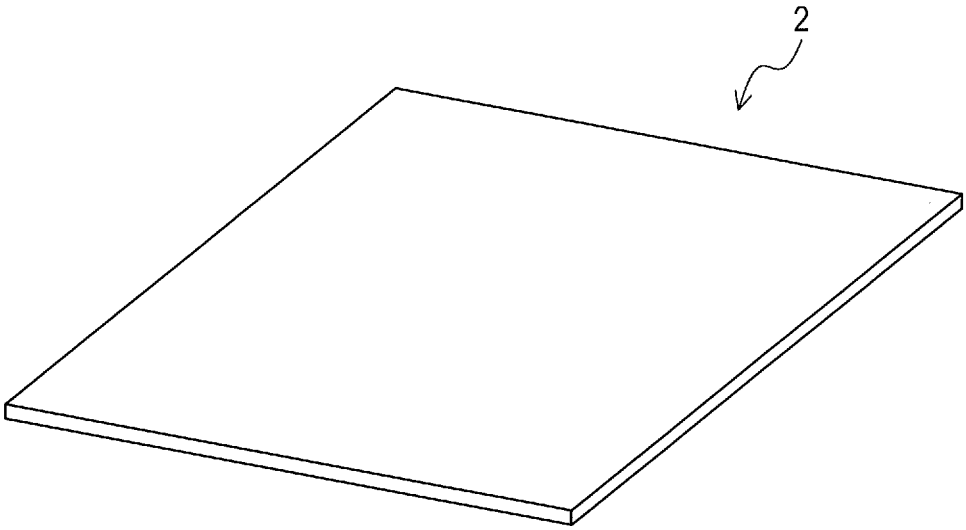
FIG. 1 is a perspective view showing a plate member of a first embodiment.
Figure 2:
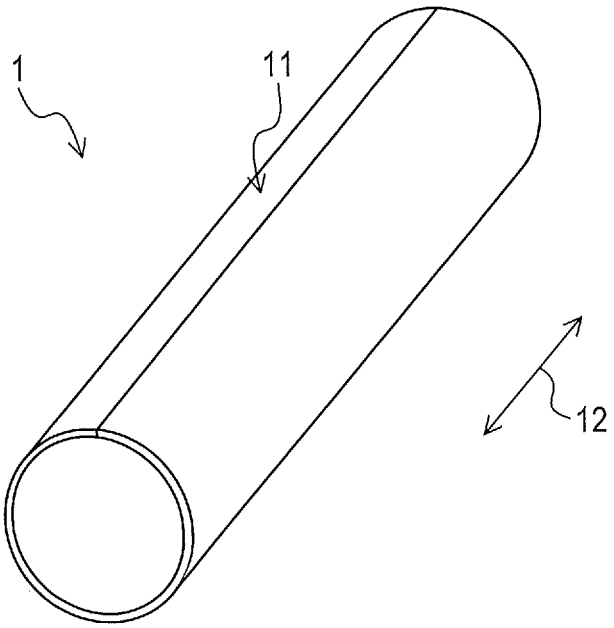
FIG. 2 is a perspective view showing a pipe of the first embodiment.
Figure 3:
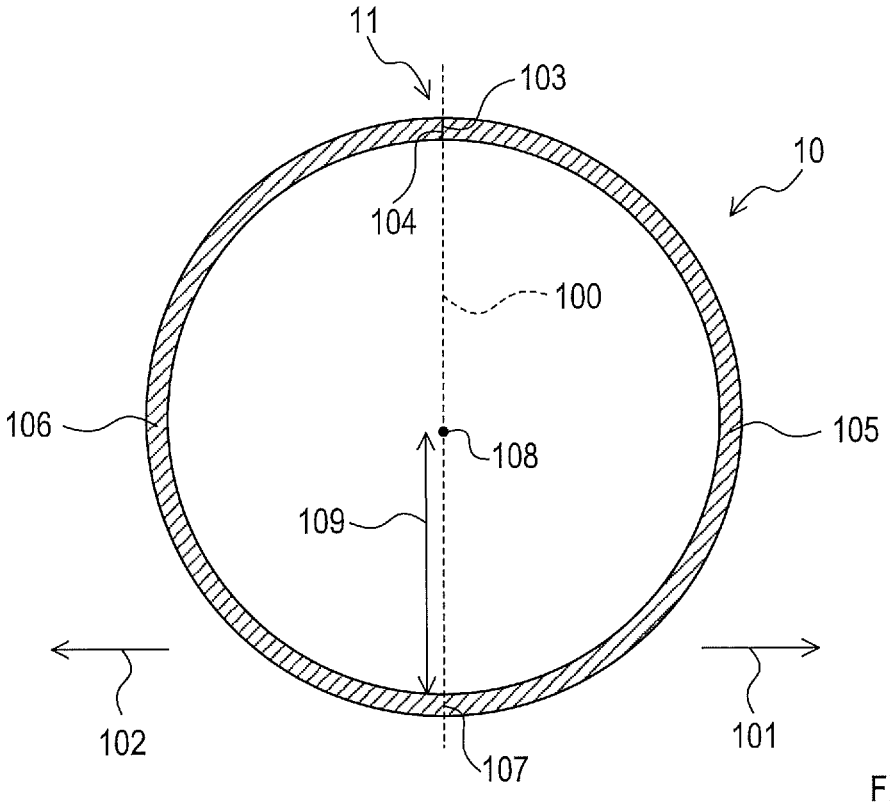
FIG. 3 is a diagram showing a pipe cross section of the first embodiment.

In a method of manufacturing a pipe 1 of a first embodiment, the pipe 1 is manufactured from a metallic rectangular plate member 2 by press molding (see FIG. 1 to FIG. 3). In one example, a cross section of the pipe 1 taken orthogonally to an elongation direction 12 (hereinafter referred to as pipe cross section 10) has an approximately circular shape. A portion of the pipe 1, where both of a right edge 103 and a left edge 104 of the curved plate member 2 face each other, is called a facing area 11. In one example, a radius of the pipe cross section 10 (hereinafter referred to as pipe radius 109) may be equal to or less than 30 mm. In one example, a thickness of the plate member 2 may be equal to or less than 1 mm. A part of the pipe 1 may include a pipe cross section having a shape different from an approximately circular shape.

In the first embodiment, a U-shape bending step and an O-shape bending step are performed on the plate member 2 to form the pipe 1 from the plate member 2. Then, in a welding step, the right edge 103 and the left edge 104 of the plate member 2 in the facing area 11 of the pipe 1, which are the edges of the plate member 2 after the O-shape bending step, are welded together to manufacture the pipe 1. The method may also include additional step or steps. The U-shape bending step and the O-shape bending step may also be considered as methods of press molding for forming a pipe.

For example, the plate member 2 may be a steel material or a stainless steel material. For example, the plate member 2 may also be a high-tensile strength steel having a tensile strength equal to or greater than 780 MPa. For example, the pipe 1 may also be used as a component of an automobile. More specifically, the pipe 1 may be a component included in a framework of a vehicle (for example, an instrument panel reinforcement). The instrument panel reinforcement is an elongated component arranged near an instrument panel of an automobile and extended along the width of the automobile.

The pipe 1 may comprise an attachment part on its outer peripheral surface for an attachment of various components (for example, a raised face or a hole). The pipe 1 may also comprise portions having different diameters and at least one contracted part for connecting these portions. The pipe 1 may be manufactured from two or more plate members made of different materials. In other words, the pipe 1 may be manufactured by preparing one plate member 2 from two or more plate materials welded together on their edges, and performing the steps of the first embodiment on the prepared plate member 2.

2. U-Shape Bending Step

Figure 4:
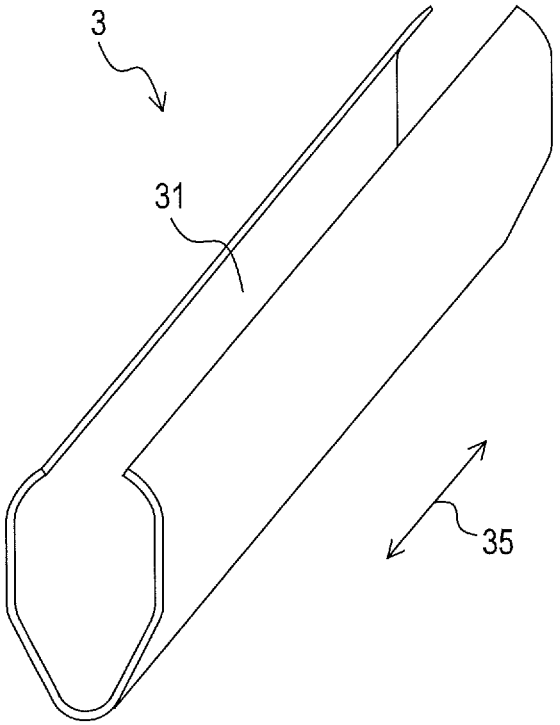
FIG. 4 is a perspective view showing a U-shaped member of the first embodiment.
Figure 5:
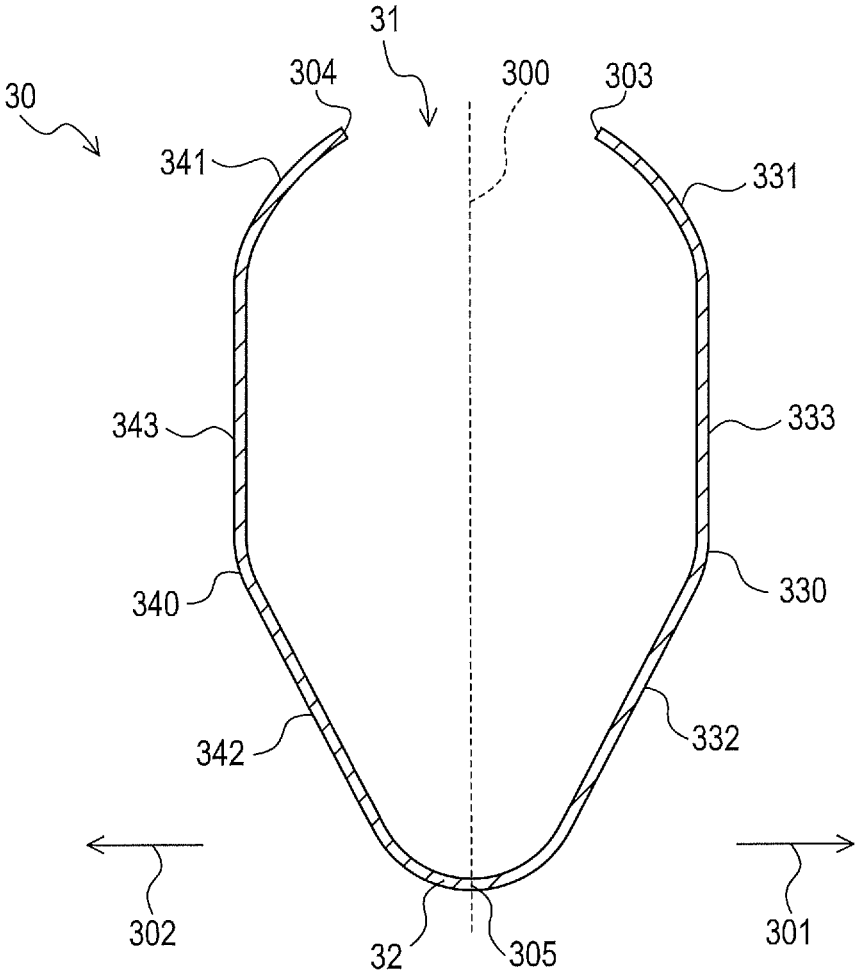
FIG. 5 is a diagram showing a U-shaped cross section of the first embodiment.

In the U-shape bending step, a U-shaped member 3, extended in an elongation direction 35, is formed by curving the plate member 2 by press molding (see FIG. 4 and FIG. 5). A metallic mold curved concavely and a metallic mold curved convexly are used in the press molding in the U-shape bending step. In the U-shape bending step, the U-shaped member 3 may be formed from the plate member 2 by performing several times of press molding using several types of metallic molds.

The U-shaped member 3 comprises a U-shaped cross section 30, which is a cross section taken orthogonally to the elongation direction 35. A part of the U-shaped member 3 may include a cross section taken orthogonally to the elongation direction 35 having a shape different from the U-shaped cross section 30. The U-shaped cross section 30 comprises at least five curved portions expanding outwards from the U-shaped cross section 30. The meaning of "expanding outwards from the U-shaped cross section 30" is to curve so as to form an arc of a circle having a center point located inside the U-shaped member 3.

One of the curved portions is a center curved portion 32. The center curved portion 32 faces an opening 31 located between a right edge 303 and a left edge 304 of the U-shaped cross section 30. An inside space and an outside space of the U-shaped member 3 communicate with each other through the opening 31. The distance between the right edge 303 and the left edge 304 across the opening 31 is the length of the opening 31 in the U-shaped cross section 30. The length of the opening 31 is shorter than a diameter of the pipe cross section 10.

A U-shaped member center line 300, which is a straight imaginary line, passes through the opening 31 and the center curved portion 32 of the U-shaped cross section 30. In one example of the present embodiment, the U-shaped member center line 300 passes a most distant point from the opening 31 in the center curved portion 32 (hereinafter referred to as base point 305). One side of the U-shaped member center line 300 is a right side 301 and the other side of the of the U-shaped member center line 300 is a left side 302. In the drawings of the first embodiment, the right side 301 is located on the right side of the drawings and the left side 302 is located on the left side of the drawings as one example.

The U-shaped cross section 30 is of an approximately line-symmetric shape having the U-shaped member center line 300 as the symmetrical axis. Nevertheless, the U-shaped cross section 30 may be of any shapes other than the approximately line-symmetric shape.

The curved portions of the U-shaped cross section 30 also include a first right curved portion 330 and a second right curved portion 331 located in the right side 301, and a first left curved portion 340 and a second left curved portion 341 located in the left side 302. In the U-shaped cross section 30, the second right curved portion 331 is located on an opening 31 side of the first right curved portion 330 (in other words, on a side of the right edge 303); the second left curved portion 341 is located on an opening 31 side of the first left curved portion 340 (in other words, on a side of the left edge 304).

Among the curved portions, at least the center curved portion 32, the first right curved portion 330, and the first left curved portion 340 are small-R portions. A small-R portion has a radius of curvature (R) smaller than the radius of curvature of a corresponding portion of the pipe cross section 10. In other words, the R of the small-R portion is smaller than the pipe radius 109.

The second right curved portion 331 extends from the right edge 303 of the U-shaped cross section 30. The second left curved portion 341 extends from the left edge 304 of the U-shaped cross section 30. Each R of the second right curved portion 331 and the second left curved portion 341 is approximately identical to the R (in other words, the pipe radius 109) of the corresponding portion of the pipe cross section 10.

The second right curved portion 331 may extend from proximity to the right edge 303 of the U-shaped cross section 30. The second left curved portion 341 may extend from proximity to the left edge 304 of the U-shaped cross section 30. In these cases, an area between the second right curved portion 331 and the right edge 303 is a right end area of the U-shaped cross section 30, and an area between the second left curved portion 341 and the left edge 304 is a left end area of the U-shaped cross section 30. The right end area and the left end area each form a straight portion extending in an approximately linear manner or form a large-R portion. The large-R portion is a part of the U-shaped cross section 30 expanding outwards from the U-shaped cross section 30. The radius of curvature (R) of the large-R portion is equal to or greater than R of a corresponding portion of the pipe cross section 10.

The U-shaped cross section 30 comprises a first right intermediate portion 332 between the center curved portion 32 and the first right curved portion 330, and a second right intermediate portion 333 between the first right curved portion 330 and the second right curved portion 331. The U-shaped cross section 30 also comprises a first left intermediate portion 342 between the center curved portion 32 and the first left curved portion 340, and a second left intermediate portion 343 between the first left curved portion 340 and the second left curved portion 341. In the first embodiment, these intermediate portions form straight line portions. Nevertheless, these intermediate portions may also form large-R portions. In other words, the U-shaped cross section 30 comprises the straight line portion or the large-R portion on both sides of the small-R portion.

3. O-Shape Bending Step

Figure 6:
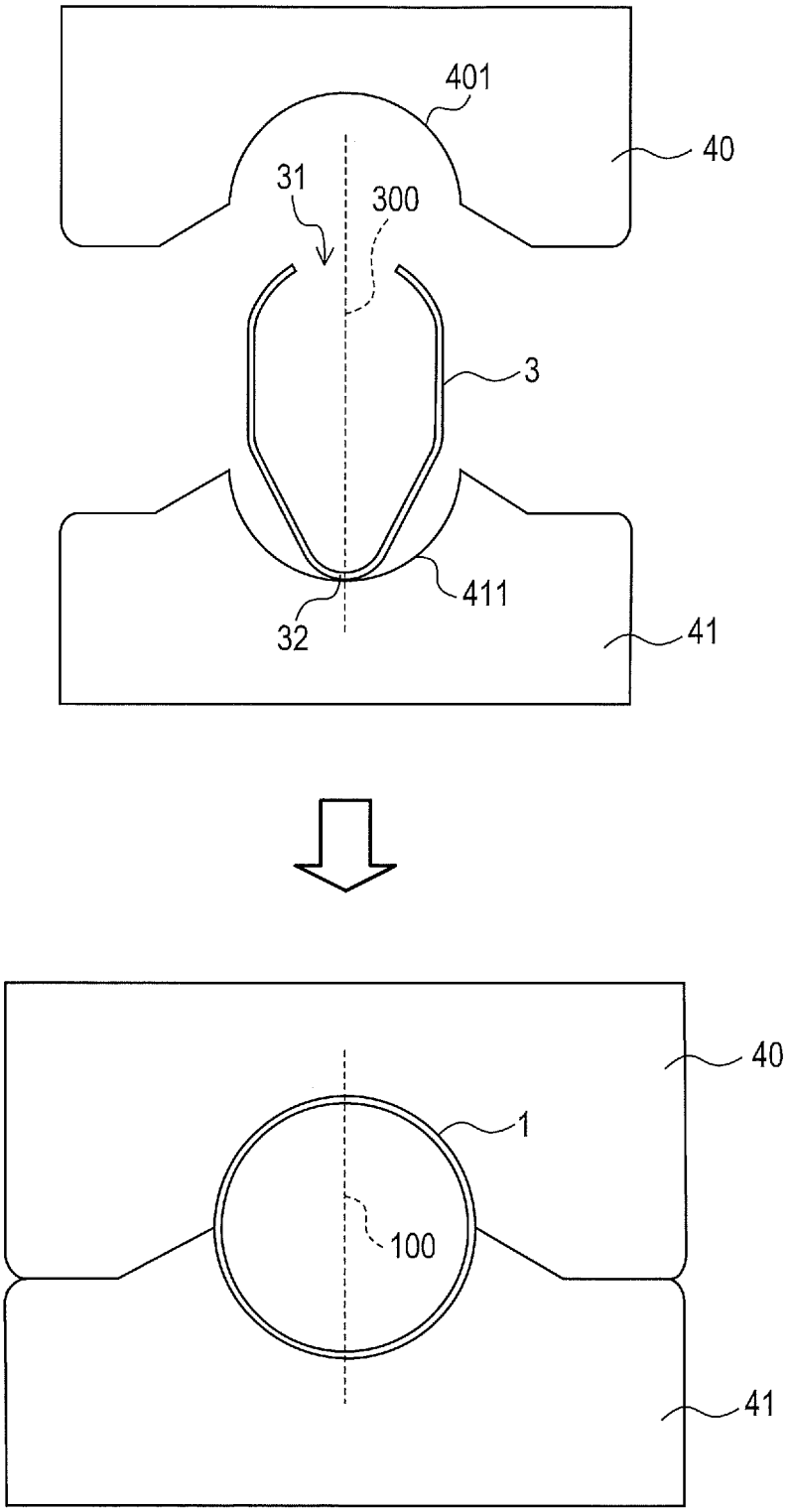
FIG. 6 is an explanatory diagram showing an O-shape bending of the first embodiment.

In the O-shape bending step, the pipe 1 is molded from the U-shaped member 3 by press molding the U-shaped member 3. Two molds, a first metallic mold 40 having a pressing surface 401 curved concavely and a second metallic mold 41 having a pressing surface 411 curved concavely, are used in the press molding in the O-shape bending step (see FIG. 6). In one example, the U-shaped member 3 is placed such that the center curved portion 32 is located on a lower side and the opening 31 is located on an upper side.

The first metallic mold 40 is arranged such that the pressing surface 401 faces the opening 31 of the U-shaped member 3. The second metallic mold 41 is arranged such that the pressing surface 411 faces the center curved portion 32 of the U-shaped member 3. The press molding is performed by moving the first metallic mold 40 and the second metallic mold 41 along the U-shaped member center line 300 to interpose and press the U-shaped member 3 between the pressing surfaces 401 and 411. At this press molding, the pressing surface 401 of the first metallic mold 40 presses a part of the U-shaped member 3 including the right edge 303 and the left edge 304, and the pressing surface 411 of the second metallic mold 41 presses a part of the U-shaped member 3 including the center curved portion 32. As a result of the O-shape bending step, the U-shaped cross section 30 is deformed into the shape of the pipe cross section 10, and the right edge 303 and the left edge 304 of the U-shaped cross section 30 face each other. In the O-shape bending step, the press molding may also be performed several times using several types of metallic molds. The O-shape bending step may also be performed by using at least one other metallic mold in addition to the first and the second metallic molds 40, 41.

The right edge 303 and the left edge 304 of the U-shaped cross section 30 face each other in the O-shape bending step. These facing edges correspond to a facing area 11 of the pipe 1 (see FIG. 3 and FIG. 5). In other words, the right edge 103 and the left edge 104 of the pipe cross section 10 respectively correspond to the right edge 303 and the left edge 304 of the U-shaped cross section 30. In the facing area 11, the right edge 103 and the left edge 104 abut each other or are located in close proximity to each other.

In the pipe cross section 10, the most distant point from the facing area 11 is a pipe base point 107. The pipe base point 107 corresponds to the base point 305 of the U-shaped cross section 30. A pipe center line 100, which is a straight imaginary line, passes through the facing area 11 and the pipe base point 107. The pipe center line 100 passes a center 108 of the pipe cross section 10. A right side 101 and a left side 102 of the pipe cross section 10 with respect to the pipe center line 100 respectively correspond to the right side 301 and the left side 302 of the U-shaped cross section 30.

The pipe cross section 10 includes a right-most distal point 105 in the right side 101, which is the most distant point from the pipe center line 100. The pipe cross section 10 also includes a left-most distant point 106 in the left side 102, which is the most distant point from the pipe center line 100.

A portion of the pipe cross section 10 corresponding to the first right curved portion 330 of the U-shaped cross section 30 includes the right-most distal point 105 or is located in proximity to the right-most distal point 105. A portion of the pipe cross section 10 corresponding to the first left curved portion 340 of the U-shaped cross section 30 includes the left-most distal point 106 or is located in proximity to the left-most distal point 106.

The portion of the pipe cross section 10 corresponding to the first right curved portion 330 of the U-shaped cross section 30 may be located on a side of the pipe base point 107 or on a side of the facing area 11 with respect to the right-most distal point 105. In addition, the portion of the pipe cross section 10 corresponding to the first left curved portion 340 of the U-shaped cross section 30 may be located on a side of the base point 107 or on a side of the facing area 11 with respect to the left-most distal point 106.

4. Welding Step

In the welding step, both edges of the plate member 2, which form the facing area 11 of the pipe 1 molded in the O-shape bending step, are welded together. In one example, the facing area 11 may be welded by laser welding. Nevertheless, any welding methods other than laser welding may also be used to weld the facing area 11.

5. Effects (1) According to the first embodiment, the center curved portion 32, the first right curved portion 330, and the first left curved portion 340 of the U-shaped cross section 30 each form a small-R portion. They are therefore deformed to increase the R when forming the pipe 1 from the U-shaped member 3 in the O-shape bending step. As a result, the springback occurs at portions of the pipe 1 corresponding to the aforementioned portions of the U-shaped cross section 30 so as to decrease the R. In the facing area 11 of the pipe 1, the springback serves as the closing force to make both of the right and left edges 103, 104 of the plate member 2 approach each other.

In the U-shaped cross section 30, the second right curved portion 331 and the second left curved portion 341 are respectively located on the opening 31 side of the first right curved portion 330 and on the opening 31 side of the first left curved portion 340. Thus, the both edges 303, 304 of the U-shaped cross section 30 can further approach each other. This helps the right and left edges 103 and 104 of the plate member 2 favorably approach each other in the facing area 11 when forming the pipe 1 from the U-shaped member 3.

Accordingly, an occurrence of a gap can be inhibited in the facing area 11 of the pipe 1.

(2) In the U-shaped cross section 30, the length of the opening 31 is less than the length of the diameter of the pipe cross section 10. Thus, the distance between the both edges 303, 304 of the U-shaped cross section 30, facing each other across the opening, is reduced. This helps the right and left edges 103 and 104 of the plate member 2 favorably approach each other in the facing area 11 of the pipe 1 in the O-shape bending step. As a consequence, an occurrence of a gap can be inhibited in the facing area 11.

(3) The R of the second right curved portion 331 and the R of the second left curved portion 341 are approximately identical to the pipe radius 109. This helps the right edge 303 and the left edge 304 favorably approach each other in the press molding in the O-shape bending step. In addition, changes in the R of the second right curved portion 331 and the R of the second left curved portion 341 can be reduced in the press molding in the O-shape bending step. Accordingly, an occurrence of springback can be inhibited in the portions of the pipe 1 corresponding to the second right curved portion 331 and the second left curved portion 341. Thus, an occurrence of a gap can be further inhibited in the facing area 11 of the pipe 1.

(4) The portion of the pipe cross section 10 corresponding to the first right curved portion 330 includes the right-most distal point 105 or is located in proximity to the right-most distal point 105. The portion of the pipe cross section 10 corresponding to the first left curved portion 340 includes the left-most distal point 106 or is located in proximity to the left-most distal point 106. Accordingly, the springback occurring at portions of the pipe 1 corresponding to the first right curved portion 330 and the first left curved portion 340 enables the closing force to effectively act on the facing area 11. Thus, an occurrence of a gap can be further inhibited in the facing area 11.

(5) The U-shaped cross section 30 is of an approximately line-symmetric shape having the U-shaped member center line 300 being the symmetrical axis. Accordingly, a portion of the pipe cross section 10 corresponding to the center curved portion 32 of the U-shaped cross section 30 is arranged in an approximately line-symmetric manner with respect to the pipe center line 100. The portions of the pipe cross section 10 corresponding to the first right curved portion 330 and the first left curved portion 340 are arranged in an approximately line-symmetric manner with each other with respect to the pipe center line 100. Similarly, portions of the pipe cross section 10 corresponding to the second right curved portion 331 and the second left curved portion 341 are arranged in an approximately line-symmetric manner with each other with respect to the pipe center line 100.

This can help encourage springback, which reduces the R, to occur at approximately identical extent and at approximately line-symmetrical locations with respect to the pipe center line 100 of the pipe cross section 10. As a result, it is possible to encourage uniform closing forces to act on both of the right and left edges 103, 104 in the facing area 11 of the pipe 1. Accordingly, the pipe 1 can be favorably molded from the U-shaped member 3.

Embodiment 2

6. Outline

Similar to the first embodiment, a method of manufacturing the pipe 1 in the second embodiment comprises three or more steps including the U-shape bending step, the O-shape bending step, and the welding step to manufacture the pipe 1. However, in the second embodiment, the shape of the U-shaped cross section 30 is different from that of the first embodiment. Hereinafter, the second embodiment will be explained mainly discussing this difference. The same reference numerals as the first embodiment suggest the same configuration, and the reference of such configuration should be made to the preceding explanations.

Figure 7:
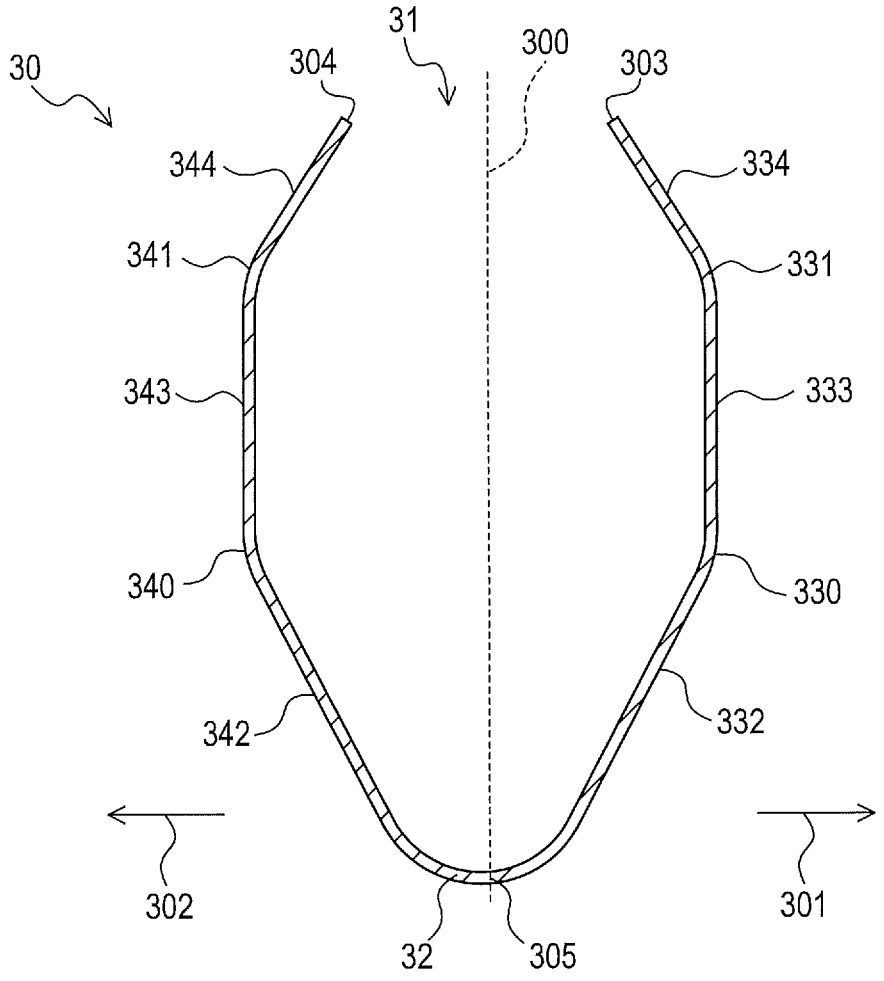
FIG. 7 is a diagram showing a U-shaped cross section of a second embodiment.

The U-shaped cross section 30 of the second embodiment is configured similarly to the first embodiment except that the second right curved portion 331 and the second left curved portion 341 are different from the first embodiment and that the second embodiment includes a right end area 334 and a left end area 344 (see FIG. 7).

More specifically, similar to the first embodiment, the second right curved portion 331 is located on an opening 31 side of the first right curved portion 330; and the second left curved portion 341 is located on an opening 31 side of the first left curved portion 340. However, the second right curved portion 331 and the second left curved portion 341 are different from those of the first embodiment in that they each form a small-R portion.

In addition, in the U-shaped cross section 30, a right end area 334 is located between the second right curved portion 331 and the right edge 303; and a left end area 344 is located between the second left curved portion 341 and the left edge 304. The right end area 334 and the left end area 344 each include a straight portion. Nevertheless, the right end area 334 and the left end area 344 may each form a large-R portion.

7. Effects

As mentioned above in the second embodiment, the second right curved portion 331 and the second left curved portion 341 in the U-shaped cross section 30 each form a small-R portion. Accordingly, springback occurs to reduce the R in the portions of the pipe 1 corresponding to the second right curved portion 331 and the second left curved portion 341 in addition to the portions of the pipe 1 corresponding to the center curved portion 32, the first right curved portion 330, and the first left curved portion 340. This consequently increases the closing force acting on the facing area 11 of the pipe 1 and helps further inhibit an occurrence of a gap in the facing area 11.

8. Other Embodiments (1) In the aforementioned embodiments, the pipe cross section may also be of an approximately elliptic shape. In this case, the shape of the U-shaped cross section, the shapes of the pressing surfaces 401 and 411 respectively of the first metallic mold 40 and the second metallic mold 41 used in the O-shape bending step, and the like are appropriately adjusted in accordance with the lengths of the long diameter and/or the short diameter of the pipe cross section. Also in this case, the U-shaped member 3 may be placed between the first metallic mold 40 and the second metallic mold 41 in the O-shape bending step such that the U-shaped member center line 300 of the U-shaped cross section 30 overlaps with the long diameter or the short diameter of the pipe cross section after the press molding. In other words, the U-shaped member 3 may be placed between the first metallic mold 40 and the second metallic mold 41 such that the facing area is located at a point of intersection of the long diameter or the short diameter of the pipe cross section.

(2) Two or more functions of one element in the aforementioned embodiments may be achieved by two or more elements; and one function of one element in the aforementioned embodiments may be achieved by two or more elements. Two or more functions of two or more elements in the aforementioned embodiments may be achieved by one element; one function of two or more elements in the aforementioned embodiments may be achieved by one element. A part of the configuration of the aforementioned embodiments may be omitted. At least a part of the configuration of the aforementioned embodiments may be added to or replaced with another configuration of the aforementioned embodiments.

What is claimed is:

1. A method of manufacturing a pipe, the method comprising:

press molding a metallic plate member to form a U-shaped member that extends in an elongation direction and includes a U-shaped cross section taken orthogonally to the elongation direction; and press molding the U-shaped member to form the pipe that extends in the elongation direction, wherein the U-shaped cross section comprises at least five curved portions expanding outwards, wherein the curved portions include a center curved portion facing an opening of the U-shaped cross section defined by both edges of the U-shaped cross section, wherein a U-shaped member center line, which is a straight line, passes through the opening and the center curved portion of the U-shaped cross section, wherein one side of the U-shaped cross section with respect to the U-shaped member center line is a right side and a second side of the U-shaped cross section with respect to the U-shaped member center line is a left side, wherein the curved portions include a first right curved portion and a second right curved portion on the right side, and a first left curved portion and a second left curved portion on the left side, wherein the second right curved portion is located on an opening side of the first right curved portion, and the second left curved portion is located on an opening side of the first left curved portion, wherein the pipe includes a pipe cross section that is a cross section taken orthogonally to the elongation direction, wherein at least the center curved portion, the first right curved portion, and the first left curved portion among the curved portions each are deformed to increase the radius of curvature when the pipe is formed by press molding of the U-shaped member, wherein the U-shaped cross section includes a right intermediate portion between the center curved portion and the first right curved portion, and a left intermediate portion between the center curved portion and the first left curved portion, wherein the right intermediate portion extends in an approximately linear manner in the U-shaped cross section, or a radius of curvature of the right intermediate portion in the U-shaped cross section is equal to or larger than a radius of curvature of a corresponding portion of the pipe cross section, and wherein the left intermediate portion extends in an approximately linear manner in the U-shaped cross section, or a radius of curvature of the left intermediate portion in the U-shaped cross section is equal to or larger than a radius of curvature of a corresponding portion of the pipe cross section.

2. The method of manufacturing a pipe according to claim 1, wherein the pipe cross section includes a circular shape.

3. The method of manufacturing a pipe according to claim 2, wherein a length of the opening of the U-shaped cross section is less than a length of a diameter of the pipe cross section.

4. The method of manufacturing a pipe according to claim 3, wherein each of the second right curved portion and the second left curved portion of the U-shaped cross section extends from one end of the U-shaped cross section or from proximity to the one end of the U-shaped cross section, and wherein radiuses of curvature of the second right curved portion and the second left curved portion are each approximately identical to a radius of curvature of a corresponding portion of the pipe cross section.

5. The method of manufacturing a pipe according to claim 3, wherein radiuses of curvature of the second right curved portion and the second left curved portion are each smaller than a radius of curvature of a corresponding portion of the pipe cross section.

6. The method of manufacturing a pipe according to claim 2, wherein each of the second right curved portion and the second left curved portion of the U-shaped cross section extends from one end of the U-shaped cross section or from proximity to the one end of the U-shaped cross section, and wherein radiuses of curvature of the second right curved portion and the second left curved portion are each approximately identical to a radius of curvature of a corresponding portion of the pipe cross section.

7. The method of manufacturing a pipe according to claim 2, wherein radiuses of curvature of the second right curved portion and the second left curved portion are each smaller than a radius of curvature of a corresponding portion of the pipe cross section.

8. The method of manufacturing a pipe according to claim 2, wherein the U-shaped cross section is of an approximately line-symmetric shape having the U-shaped member center line being a symmetrical axis.

9. The method of manufacturing a pipe according to claim 2, wherein a tensile strength of the plate member is equal to or greater than 780 MPa.

10. The method of manufacturing a pipe according to claim 2, wherein the pipe is a component included in a framework of an automobile.

11. The method of manufacturing a pipe according to claim 2, wherein the press molding of the U-shaped member is performed by using at least a first metallic mold for pressing a part of the U-shaped member including said both edges of the U-shaped cross section; and a second metallic mold for pressing a second part of the U-shaped member including the center curved portion.

12. The method of manufacturing a pipe according to claim 2, wherein the press molding of the U-shaped member includes at least interposing and pressing the U-shaped member between a first metallic mold and a second metallic mold, both moving along the U-shaped member center line.

13. The method of manufacturing a pipe according to claim 1, wherein radiuses of curvature of the second right curved portion and the second left curved portion are each smaller than a radius of curvature of a corresponding portion of the pipe cross section.

14. The method of manufacturing a pipe according to claim 1, wherein the U-shaped cross section is of an approximately line-symmetric shape having the U-shaped member center line being a symmetrical axis.

15. The method of manufacturing a pipe according to claim 1, wherein a tensile strength of the plate member is equal to or greater than 780 MPa.

16. The method of manufacturing a pipe according to claim 1, wherein the pipe is a component included in a framework of an automobile.

17. The method of manufacturing a pipe according to claim 1, wherein the press molding of the U-shaped member is performed by using at least a first metallic mold for pressing a part of the U-shaped member including said both edges of the U-shaped cross section; and a second metallic mold for pressing a second part of the U-shaped member including the center curved portion.

18. The method of manufacturing a pipe according to claim 1, wherein the press molding of the U-shaped member includes at least interposing and pressing the U-shaped member between a first metallic mold and a second metallic mold, both moving along the U-shaped member center line.

19. A method of manufacturing a pipe comprising:

press molding a metallic plate member to form a U-shaped member that extends in an elongation direction and includes a U-shaped cross section taken orthogonally to the elongation direction; and press molding the U-shaped member to form the pipe that extends in the elongation direction, wherein the U-shaped cross section comprises at least five curved portions expanding outwards, wherein the curved portions include a center curved portion facing an opening of the U-shaped cross section defined by both edges of the U-shaped cross section, wherein a U-shaped member center line, which is a straight line, passes through the opening and the center curved portion of the U-shaped cross section, wherein one side of the U-shaped cross section with respect to the U-shaped member center line is a right side and a second side of the U-shaped cross section with respect to the U-shaped member center line is a left side, wherein the curved portions include a first right curved portion and a second right curved portion on the right side, and a first left curved portion and a second left curved portion on the left side, wherein the second right curved portion is located on an opening side of the first right curved portion, and the second left curved portion is located on an opening side of the first left curved portion, wherein the pipe includes a pipe cross section that is a cross section taken orthogonally to the elongation direction, wherein at least the center curved portion, the first right curved portion, and the first left curved portion among the curved portions each are deformed so as to increase the radius of curvature when the pipe is formed by press molding of the U-shaped member, wherein a pipe center line, which is a straight line, passes through a facing area where said both edges of the pipe cross section face each other and a most distant portion of the pipe cross section from the facing area, wherein the pipe cross section includes a right-most distal point that is a most distant point from the pipe center line in a portion corresponding to the right side of the U-shaped cross section, wherein the pipe cross section includes a left-most distal point that is a most distant point from the pipe center line in a portion corresponding to the left side of the U-shaped cross section, wherein a portion of the pipe cross section corresponding to the first right curved portion includes the right-most distal point, and wherein a portion of the pipe cross section corresponding to the first left curved portion includes the left-most distal point.

20. A method of manufacturing a pipe comprising:

press molding a metallic plate member to form a U-shaped member that extends in an elongation direction and includes a U-shaped cross section taken orthogonally to the elongation direction; and press molding the U-shaped member to form the pipe that extends in the elongation direction, wherein the U-shaped cross section comprises at least five curved portions expanding outwards, wherein the curved portions include a center curved portion facing an opening of the U-shaped cross section defined by both edges of the U-shaped cross section, wherein a U-shaped member center line, which is a straight line, passes through the opening and the center curved portion of the U-shaped cross section, wherein one side of the U-shaped cross section with respect to the U-shaped member center line is a right side and a second side of the U-shaped cross section with respect to the U-shaped member center line is a left side, wherein the curved portions include a first right curved portion and a second right curved portion on the right side, and a first left curved portion and a second left curved portion on the left side, wherein the second right curved portion is located on an opening side of the first right curved portion, and the second left curved portion is located on an opening side of the first left curved portion, wherein the pipe includes a pipe cross section that is a cross section taken orthogonally to the elongation direction, wherein at least the center curved portion, the first right curved portion, and the first left curved portion among the curved portions each are deformed so as to increase the radius of curvature when the pipe is formed by press molding of the U-shaped member, wherein the pipe cross section includes a circular shape, wherein a pipe center line, which is a straight line, passes through a facing area where said both edges of the pipe cross section face each other and a most distant portion of the pipe cross section from the facing area, wherein the pipe cross section includes a right-most distal point that is a most distant point from the pipe center line in a portion corresponding to the right side of the U-shaped cross section, wherein the pipe cross section includes a left-most distal point that is a most distant point from the pipe center line in a portion corresponding to the left side of the U-shaped cross section, wherein a portion of the pipe cross section corresponding to the first right curved portion includes the right-most distal point, and wherein a portion of the pipe cross section corresponding to the first left curved portion includes the left-most distal point.

* * * * *